US005340358A

United States Patent [19]

Halupczok et al.

[11] Patent Number: 5,340,358

[45] Date of Patent: Aug. 23, 1994

[54] AIR VENT

[75] Inventors: Johann Halupczok, Aachen; Franc Sodec, Wurselen, both of Fed. Rep. of Germany

[73] Assignee: H. Krantz-TKT GmbH, Berisch Gladbach, Fed. Rep. of Germany

[21] Appl. No.: 61,586

[22] Filed: May 14, 1993

[51] Int. Cl.[5] ..... F24F 13/06

[52] U.S. Cl. ..... 454/299; 454/302; 454/305

[58] Field of Search ..... 454/292, 299, 302, 303, 454/305

[56] References Cited

U.S. PATENT DOCUMENTS

| | | | |
|---|---|---|---|
| 2,558,421 | 6/1951 | Daninhirsch | 454/302 |
| 2,791,170 | 5/1957 | Phillips et al. | 454/299 |
| 3,765,316 | 10/1973 | Skoch | 454/292 |

FOREIGN PATENT DOCUMENTS

| | | | |
|---|---|---|---|
| 2634786 | 2/1978 | Fed. Rep. of Germany | 454/305 |
| 796457 | 1/1981 | U.S.S.R. | 454/305 |
| 547539 | 9/1942 | United Kingdom | 454/299 |

*Primary Examiner*—Harold Joyce
*Attorney, Agent, or Firm*—Mark T. Basseches

[57] ABSTRACT

An air vent for the generation of high turbulence air jets is comprised of a rotationally symmetrical casing having a flared discharge mouth. A deflector plate is mounted in the plane of the mouth to define with the mouth an annular discharge opening. An air guide is mounted within the casing that includes an annular flared deflector portion located adjacent the discharge mouth of the casing. Radially extending twist paddles or fins are mounted on the air guide to impart a twist to the air stream. The air guide is preferably adjustably mounted within the casing for movement axially thereof whereby when the deflector portion of the guide is disposed above the plane of the mouth portion a spreading of the air stream is achieved, and when the deflector is located below the plane of the mouth portion a concentration of the stream is achieved, intermediate effects being achieved at intermediate positions of the guide relative to the casing.

7 Claims, 3 Drawing Sheets

Fig. 1
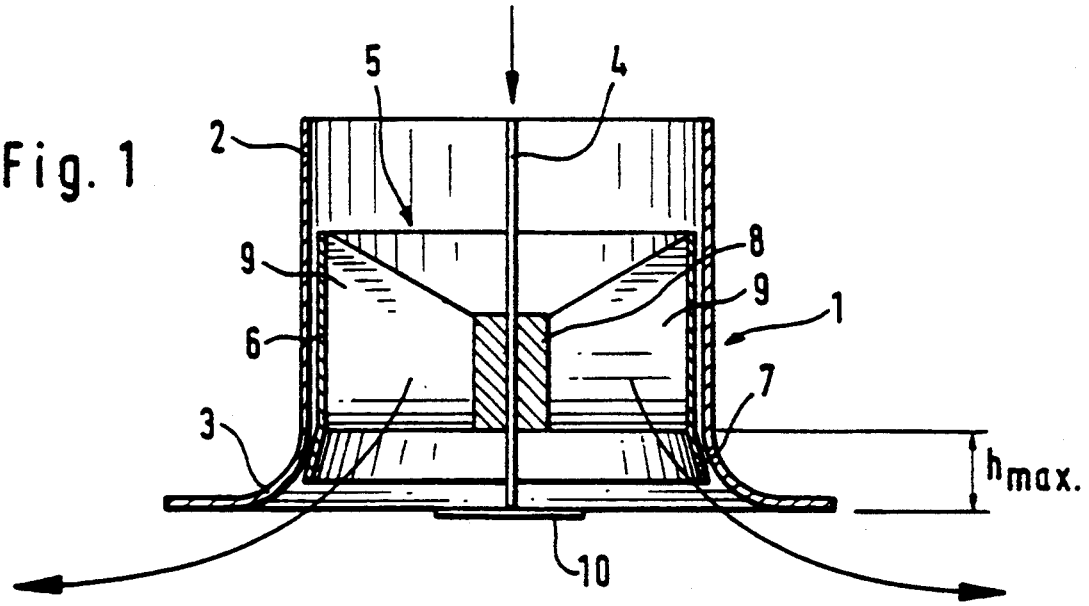
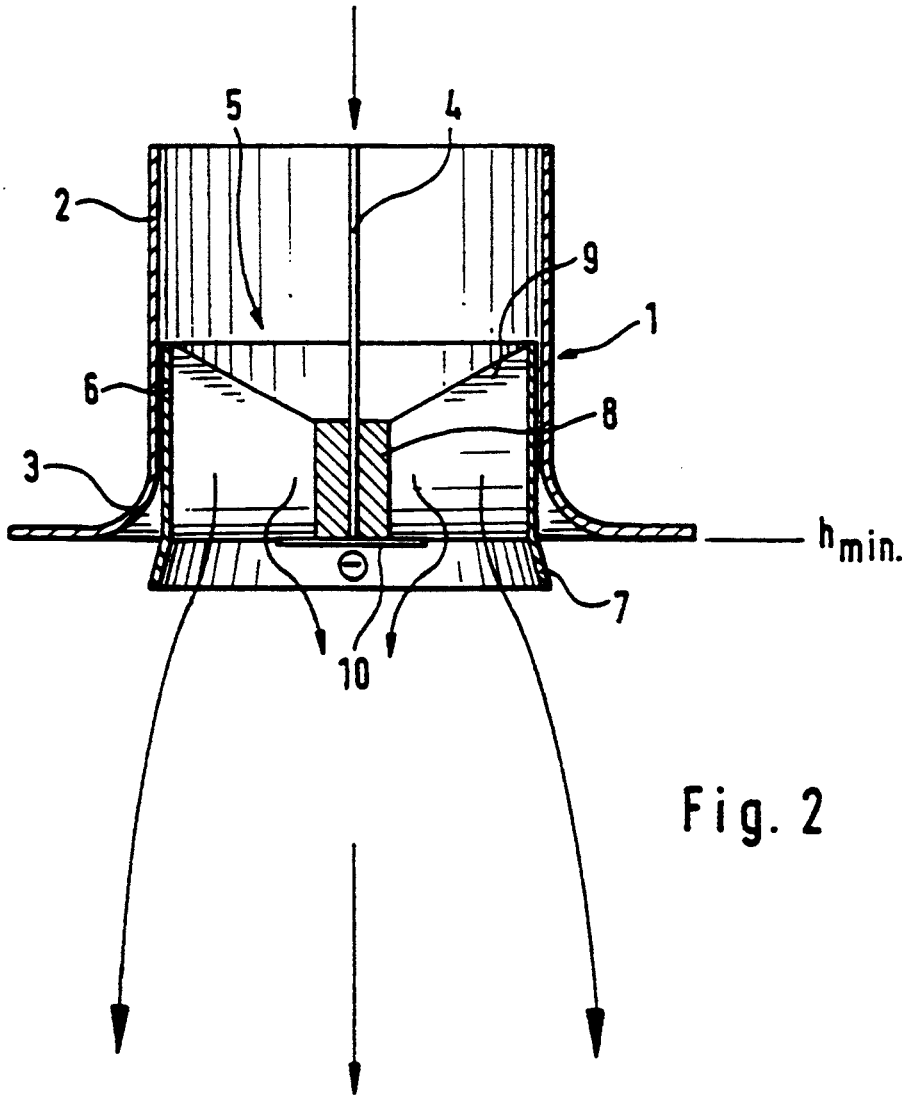
Fig. 2

AIR VENT

BACKGROUND AND FIELD OF THE INVENTION

This invention relates to an air distribution vent, i.e. for room ventilation or the like, having a rotationally symmetrical casing with a cylindrical intake part, an air guidance element arranged coaxially within the casing in a vertically adjustable manner, and a deflecting plate which is rigidly fastened to the casing and which with an outlet part of the casing defines an annular outlet cross-section.

PRIOR ART

Such an air vent is known from patent specification GB-PS 624,932. Depending on the position of the annular air guidance element within the casing of the known device, the air which is to be introduced into a room either is fed into the room more or less horizontally by the air guidance element or is deflected by the outside of the air guidance element and fed into the room more or less vertically.

For the generation of high-turbulence air jets which are blow out either axially or radially it is known to employ air vents equipped with twist fins or paddles, i.e. vanes which are angled relative to the air stream. Although in an intermediate position of the air guidance element of known devices such air vents permit a diagonal blowout direction of the air jets, the air jets are unstable.

If, as an experiment, the air guidance element known from patent specification GB-PS 624,932 were equipped with twist paddles, only high-turbulence air jets with a radial blowout direction could be generated since, at a position of the air guidance element for the axial outflow direction, the air would flow around the guidance element. As a result the air stream would be totally removed from the effect of the twist paddles.

SUMMARY OF THE INVENTION

The present invention addresses the task of forming an air vent of the kind initially described in such a way that high-turbulence air jets can be generated by it whose stability is guaranteed not only in the case of an axial or radial blowout direction but also in every intermediate position, that is, in the case of jets which are directed diagonally into the room.

In order to satisfy such requirements there is provided an air vent comprised of a rotationally symmetrical casing having an outwardly flared mouth portion, the casing including a deflector plate mounted in the plane of the mouth portion and defining, at the mouth, an annular opening. A generally cylindrical air guide member is coaxially mounted within and is preferably axially adjustable relative to the casing. The guide member includes an outwardly flared annular terminal deflector and a series of radially extending twist fins or paddles for imparting circular motion to the air stream. When the deflector of the guide is located at a plane above the plane of the mouth portion, a wide spread horizontal distribution of the air stream results. When the guide deflector is located below the plane of the mouth portion a narrow vertical flow results, with diagonal flow patterns resulting from intermediate positions of the guide within the casing.

Through the adjustment, in accordance with the invention, of the air guidance element within the casing, the entire supplied air stream in every position of the air guidance element is guided over the twist paddles which are arranged radially and angularly to the air stream in its cylindrical intake part, with the result that exclusively high-turbulence air jets emerge from the air vent. If it is intended to have a radial blowout direction the air guidance element is arranged at a distance above the deflecting plate which is rigidly fastened to the casing so that the jets flow along the inside of the outlet part of the casing which widens in the direction of the flow and thus are guided horizontally, for example along the ceiling of a room which is to be ventilated. If, on the other hand, the air flow is to enter the room axially the air guidance element with the twist paddles is lowered onto the deflecting plate with the result that, on the one hand, the inside contour of the outlet part of the air guidance element permits the jets to emerge axially and, on the other hand, a partial vacuum is produced under the deflecting plate which contracts the axial flow. If the air guidance element is arranged in an intermediate position between its lowest and highest position within the casing, an air flow is generated which correspondingly is directed diagonally into the room. In every case, however, the air vent in accordance with the present invention ensures that the emerging air jets are highly turbulent and stable.

In one formulation of the invention the outlet cross section of the air guidance element has a diameter which, in relation to the diameters of the outlet part or mouth of the casing, is larger than its smallest diameter and is smaller than its largest diameter.

The outlet part of the air guidance element, which is preferably in the shape of a truncated cone, thus can be adjusted between, on the one hand, a lower end position limited by the deflecting plate, and on the other hand, an upper end position limited by the contact of the deflector of the air guidance element with the interior wall of the outlet part of the casing.

Preferably the guidance element can be adjusted axially of the casing to a low point at which the twist paddles touch the deflecting plate, with the outlet part of the air guidance element enclosing the deflecting plate and protruding beyond the outlet cross section of the casing.

In this embodiment, in the lower position of the air guidance element, its outlet part, with its contour in the shape of a truncated cone, determines the axial blowout direction.

According to a further embodiment of the invention, the deflecting plate is mounted to the casing by means of a rod over which the air guidance element can be continuously vertically adjusted.

The rod can be formed as a threaded rod over which the air guidance element can be adjusted by means of providing the central hub of the guide with an internal thread, adjustment being effected through a rotation of the threaded rod or also of the air guidance element as a whole. The adjustment can take place with the help of a motor drive or also be performed manually.

Finally, an embodiment of the present invention also provides that the outside diameter of the cylindrical intake part of the air guidance system corresponds to the inside diameter of the cylindrical intake part of the casing.

As a result of this construction the entire air flow is guided through the air guidance element without partial flows being able to emerge untwisted from the air vent between the outside casing and the air guidance element.

BRIEF DESCRIPTION OF DRAWINGS

The drawings show a schematic sectional representation of an example of the execution of an air vent in accordance with the present invention. The different figures show the following situations:

FIG. 1, the vent in the case of a radial blowout direction.

FIG. 2, the vent in the case of an axial blowout direction,

Figure 3:
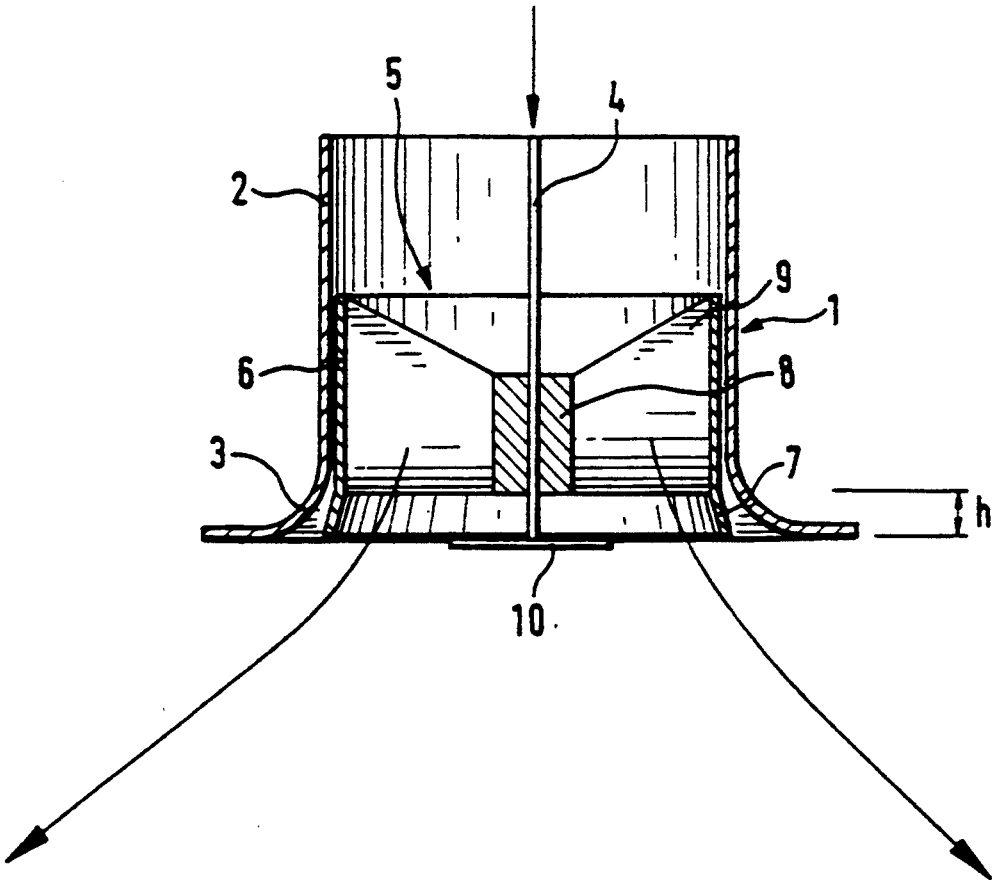
FIG. 3, the vent in the case of a diagonal blowout direction.
Figure 4:
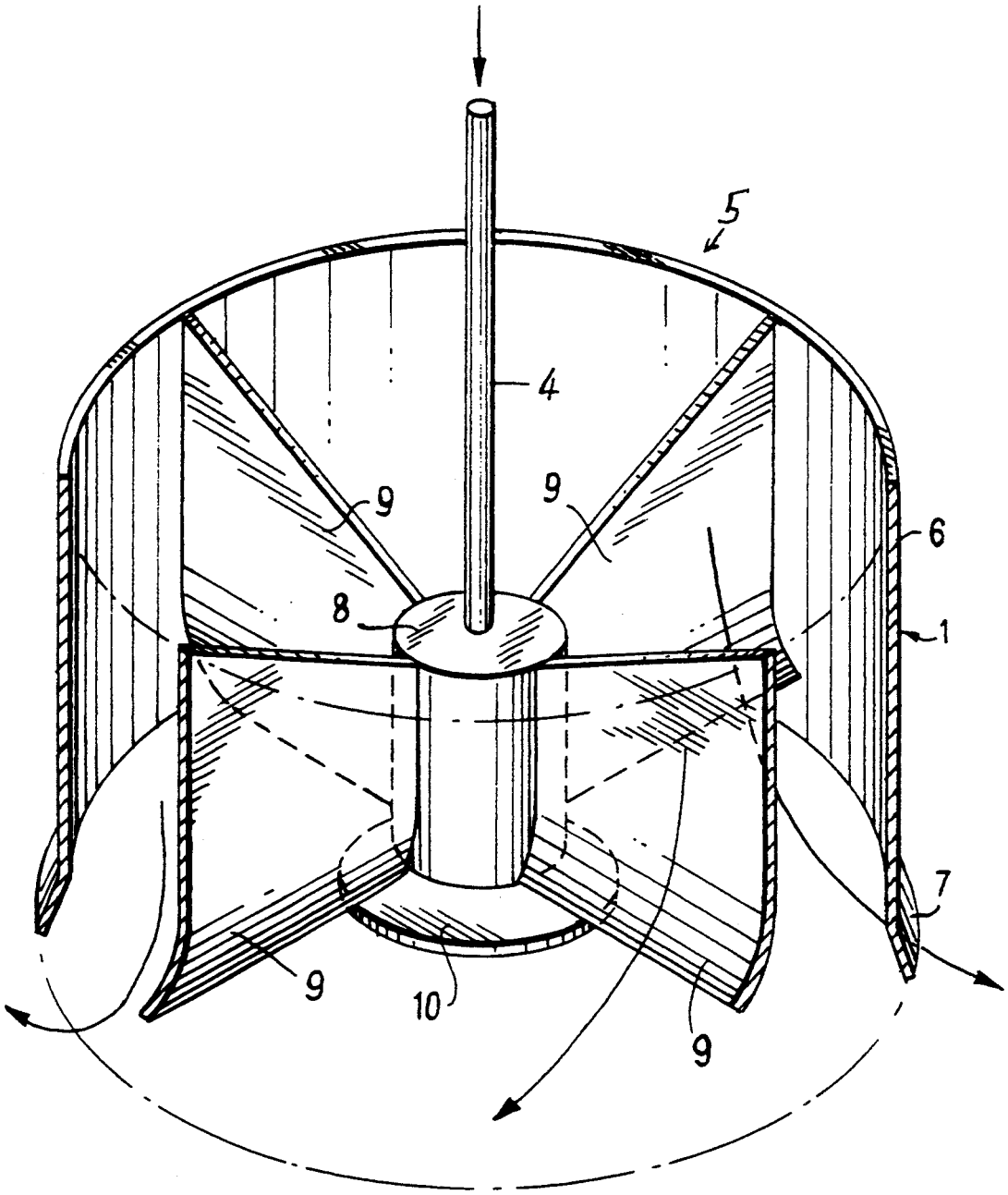
FIG. 4 is an enlarged perspective view of internal components of the vent.

The air vent comprises a rotationally symmetrical casing 1. The casing is composed of a cylindrical intake part 2 and an outlet part 3 which widens in the shape of a trumpet in the direction of the flow.

In casing 1 an air guidance element 5 is placed in a vertically adjustable manner over a rod 4 which is arranged concentrically in the casing. The air guidance element 5 also is composed of a cylindrical intake part 6 and an outlet part 7 which widens in the shape of a truncated cone in the direction of the flow.

In the intake part 6 of the air guidance element 5 a hub 8 is arranged with twist paddles 9 which extend radially and angularly (relative the axis of the casing) over the annular space between the hub 8 and the inside of the intake part 6.

On the bottom side of the casing 1 a circular deflecting plate 10 is arranged in the plane of the outlet cross section of the outlet part 3 of the casing. The deflecting plate 10 is attached to the lower end of rod 4.

The air guidance element 5 can be adjusted from the highest position indicated in FIG. 1 with h max to the lowest position indicated in FIG. 2 with h min. In addition, the air guidance element can occupy any intermediate position located between these two extreme positions; one such intermediate position being indicated in FIG. 2 with h. Adjustment is achieved by providing rod 4 with an external thread which engages a complimentary threaded portion of hub 8.

In the position of the air guidance element 5 represented in FIG. 1, the emerging jets are radially deflected. In the position of the air guidance element 5 represented in FIG. 2 the direction of the outflow of the jets is axial. In the intermediate position of the air guidance element 5 represented in FIG. 3 the direction of the outflow of the jets is diagonal.

As will be apparent from the preceding description, there is provided, in accordance with the invention, an air vent adapted to efficiently and preferably adjustably control the spread of an air stream. Since numerous variations in details of construction will occur to skilled workers in the art familiarized with the instant disclosure, the invention is to be broadly construed within the scope of the appended claims.

Having thus described the invention and illustrated its use, what is claimed as new and is desired to be secured by Letters Patent is:

1. An air vent comprising a casing having a generally cylindrical body portion terminating in a radially outwardly flared mouth, a deflector plate mounted to said casing in coplanar alignment with said mouth, said plate and mouth defining an annular opening therebetween, an air guide member coaxially mounted within said casing and including a cylindrical skirt having an outwardly flared terminal deflector portion disposed in proximate relation to said mouth, a central hub on said guide member, and a plurality of air twist fins extending radially between said hub and skirt.

2. An air vent in accordance with claim 1 and including adjustable mounting means in said casing supporting said guide member for enabling axial shifting of said guide member within said casing thereby to vary the spacing between said mouth portion and said deflector portion.

3. Apparatus in accordance with claim 2 wherein said mounting means comprises a threaded rod coaxially depending from said casing and said deflector plate is mounted on a distal end of said rod.

4. An air vent in accordance with claim 2 wherein said twist fins include terminal edge portions juxtaposed to said deflector plate, said guide member being shiftable by said mounting means to a limit position whereat said terminal edge portions of said fins engage said deflector plate and said deflector portion projects axially outwardly beyond said mouth.

5. An air vent in accordance with claim 1 wherein the outer diameter of said deflector portion is larger than the diameter of said body portion of said casing and smaller than the outer diameter of said mouth.

6. An air vent in accordance with claim 1 wherein said cylindrical skirt of said guide member is disposed in sliding engagement with said cylindrical body of said casing.

7. An air distribution vent comprising a casing having a generally cylindrical input end and a radially outwardly flared discharge mouth, a circular deflector plate mounted to said casing in coplanar alignment with said mouth, said plate and mouth together defining an annular opening therebetween, an air guide member coaxially mounted within said casing, said guide member including a cylindrical skirt in intimate sliding engagement with said input end of said casing and an annular outwardly flared deflector portion disposed in proximate relation to said discharge mouth, the diameter of said deflector portion being greater than the diameter of said input end of said casing and less than the outer diameter of said discharge mouth, a central hub on said guide member aligned with the axis of said input end of said casing, a plurality of air twist fins extending radially between said hub and skirt, said fins being angled relative to the axis of said casing, and adjustment means interposed between said guide member for shifting said guide member axially of said casing whereby said deflector portion of said guide member is adjustably positionable between locations to opposite sides of the plane of said mouth portion.

* * * * *